United States Patent [19]

Wolf et al.

[11] Patent Number: 4,657,597

[45] Date of Patent: Apr. 14, 1987

[54] CHIMNEY CLEANER

[76] Inventors: Roger H. Wolf, Rte. 1, Box 222; Bruce L. Johnson, Rte. 1, Box 59, both of Wrenshall, Minn. 55797

[21] Appl. No.: 783,267

[22] Filed: Oct. 4, 1985

Related U.S. Application Data

[63] Continuation of Ser. No. 631,324, Jul. 16, 1984, abandoned.

[51] Int. Cl.[4] ..... B08B 9/04

[52] U.S. Cl. ..... 134/8; 15/104.16; 15/242; 15/249

[58] Field of Search ..... 134/8; 15/104.16, 104.07, 15/242, 243, 249

[56] References Cited

U.S. PATENT DOCUMENTS 4,409,703 10/1983 Marcellus ..... 15/249

*Primary Examiner*—Andrew H. Metz
*Assistant Examiner*—Sharon T. Cohen
*Attorney, Agent, or Firm*—John P. Sumner

[57] ABSTRACT

Disclosed is a chimney cleaner for cleaning a chimney flue wall. The cleaner comprises a plate having a scraping edge and support apparatus for suspending the plate between a weight and a flexible member.

26 Claims, 5 Drawing Figures

CHIMNEY CLEANER

BACKGROUND AND SUMMARY OF THE INVENTION

This application is a continuation of Ser. No. 631,324, filed July 16, 1984, now abandoned.

The present invention is a chimney cleaner which is of more simple design than prior art chimney cleaners, and which is faster, cleaner, and more easily used than prior art cleaners. Further, the simple design is inexpensive to fabricate and is virtually indestructible. It may also be made sufficiently small so that it will not become "stuck" inside the chimney, a significant problem with brushes and expanding type cleaners.

The present invention also provides a unique, automatic "hugging" feature as well as improved cleaning action achieved through a novel pivoting characteristic. These unique features are not found in the prior art. Further, the features are accomplished through the elegant simplicity of the present invention, which comprises a plate having a scraping edge and support apparatus for suspending the plate between a weight and a flexible member.

DESCRIPTION OF THE PREFERRED EMBODIMENT

Figure 1:
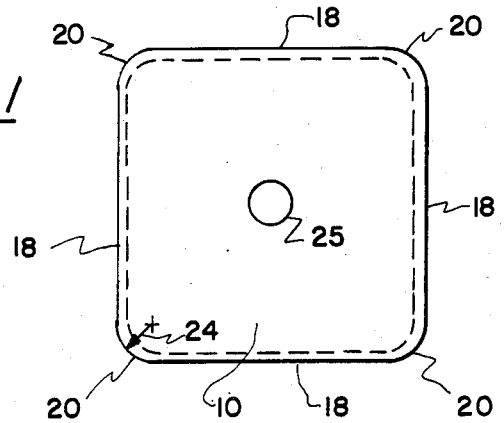
FIGS. 1 and 2 illustrate a preferred embodiment of the present invention.
Figure 2:
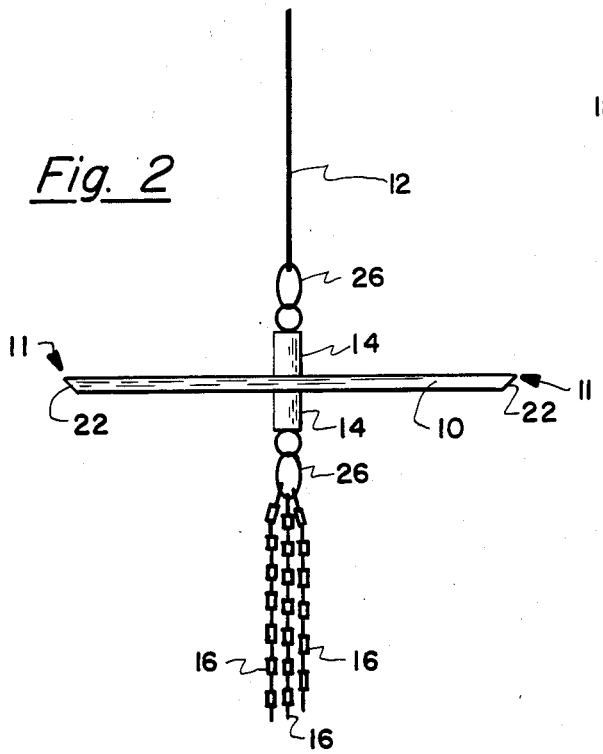

The present invention comprises a plate 10 having a scraping edge and support apparatus 14 for suspending plate 10 between a weight 16 and a flexible member 12.

In the embodiment shown, support apparatus 14 comprises apertured supports 14 which permit the plate to pivot while being held generally normally to a chimney flue wall 28. These apertured supports 14 in combination with plate 10, when used in accordance with the present invention, cause the scraping edge of the plate to automatically "hug" the chimney flue wall, i.e., to automatically force the scraping edge into the chiminey flue wall.

Figure 4:
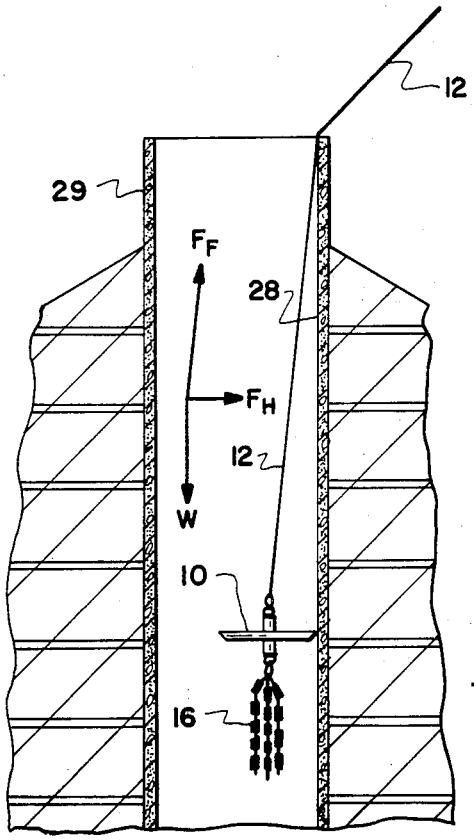

Thus, it can be seen from the vector diagram in FIG. 4 that use of the present invention as disclosed results in a "hugging" force $F_H$ of edge 11 against wall 28, $F_H$ resulting from force W exerted by weight 16 and flexible member force $F_F$ exerted by flexible member 12. This automatic "hugging" together with improved scraping action achieved through the pivoting of plate 10 are unique features not found in the prior art.

While many configurations, materials, and sizes may be used, plate 10 is shown here to be physically square in configuration, having four substantially perpendicular edges 18. A 5"×5" plate has been found to be satisfactory and is preferred, since a substantially larger plate can become stuck in small chimneys, whereas a plate sized substantially smaller than 5"×5" reduces cleaning effectiveness. A plate thickness of ⅛" is satisfactory; mild steel may be used, but higher grades of steel hold a scraping edge longer. Other materials may also be used.

In a preferred embodiment of the present invention, each of the adjoining substantially perpendicular edges 18 are joined by a radius 20 which substantially conforms to a radius of a chimney flue corner. A radius 20 having a dimension 24 of one inch has been found to be satisfactory. Further, in the preferred embodiment, each of the four edges 18 and each radii 20 are bevelled with a bevel 22 such as 45 degrees, thus forming an enhanced scraping edge 11 around the entire circumference of plate 10.

Support apparatus 14 may be formed of two back-to-back chimney pull rings or other apertured supports 14. In the embodiment shown, chimney pull rings 14 are coupled through a 9/16" hole 25 in the center of plate 10 by a ¼" close pipe nipple (not shown).

Figure 5:
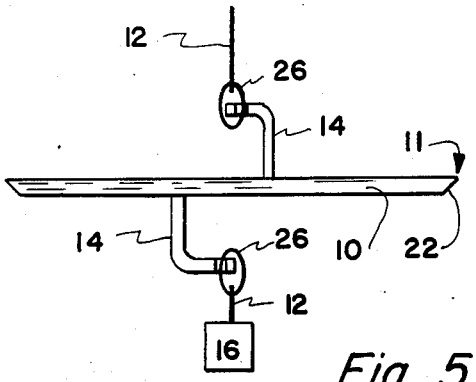
FIG. 5 illustrates an alternate embodiment of the present invention.

Apertured supports 14 could be integrated to plate 10 (rather than separate pieces attached to plate 20). Supports 14 preferrably extend at least two inches above and below plate 10 in order to hold plate 10 substantially normal to wall 28. Strength and rigidity of supports 14 are important in order to maintain the automatic hugging and enhanced scraping action of the present invention. Apertured supports 14, while preferrably attached to the center of plate 10, could be attached at other plate locations and configured to hold plate 10 generally normally to chimney flue wall 28. See, for example, FIG. 5.

The present invention is used in conjunction with a flexible member 12 such as a rope attached to the upper side of plate 10 by an apertured support 14. In the embodiment shown, flexible member 12 in shown attached to apertured support 14 by an optional snap hook 26.

A weight, typically 8 to 10 pounds, is attached to the lower side of plate 10 by an apertured support 14. In the embodiment shown, apertured support 14 is used together with an optional snap hook 26.

It has been found that chain 16, for example, three two foot lengths of chain, serves very well to provide weight 16 as well as supplementary cleaning action. Alternate or additional weights may also be used.

Figure 3:
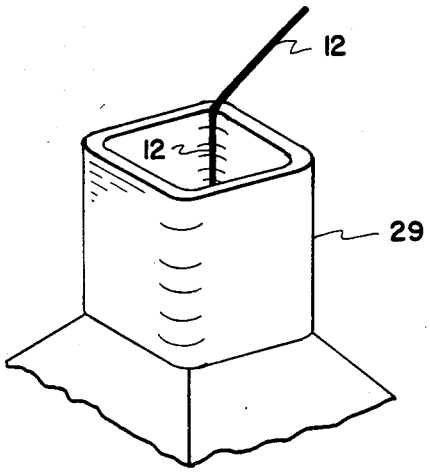
FIGS. 3 and 4 illustrate the use of the present invention.

In using the present chimney cleaner, the cleaner is typically placed into a chimney flue 29 from the top of the flue, and rope 12 or other flexible member is typically supported by one of the four corners at the upper end of the flue (see FIG. 3). By moving rope 12 so that it slides up and down a flue 29 and across a top corner of the flue, the cleaner is correspondingly raised and lowered along flue sides 28 which adjoin the corner where the rope is placed. Using this preferred method of operating the present invention, i.e., by sliding flexible member 12 across an upper corner of a chimney flue, plate 10 automatically "hugs" the walls of the flue. This automatic "hugging" action of the present invention is brought about by suspending apertured supports 14 between flexible member 12 and weight 16. This automatic "hugging" action enhances ease of cleaning and permits a person to stand back several feet from the chimney, thus minimizing exposure to creosote dust and the like.

As previously indicated, it is normally easiest to use the present cleaner by allowing rope or other flexible member 12 to slide across the top corner of a chimney flue 29. In using this approach, the present cleaner may either be allowed to slide all the way down the length of the chimney and be withdrawn all the way up the chimney or may be allowed to go down, for example, two or three feet, then up a foot or two and then down, etc. Using either of these or other approaches, the lowering and raising of flexible member 12 down each of the four corners of a chimney flue 29 only once is usually all that is needed to clean the flue. This process is repeated for each flue 29 in the chimney.

The present invention is to be limited only in accordance with the appended claims since persons skilled in the art may devise alternates to the preferred embodiment and still be within the scope of the present invention. For example, dimensions and other construction details are illustrative only and are not to be taken as limiting the scope of the present invention.

The embodiments of the invention in which an exclusive property or right is claimed are defined as follows:

1. A chimney cleaner for cleaning a chimney flue wall, comprising:

a plate having a scraping edge; and support means for suspending the plate between a weight and a flexible member, the support means comprising means for permitting the plate to pivot between the weight and the flexible member and for holding the plate generally normally to the chimney flue wall.

2. The apparatus of claim 1 wherein the support means comprises:

a first rigid member extending orthogonally from the surface of the plate in a first direction at a site on the plate spaced from the edge of the plate, the first rigid member having an end spaced away from the plate;

means for connecting a flexible member to the end of the first rigid member spaced away from the plate;

a second rigid member extending orthogonally from the surface of the plate in a second direction at a site on the plate spaced from the edge of the plate, the second rigid member having an end spaced away from the surface of the plate; and means for connecting a weight to the end of the second rigid member spaced away from the plate.

3. The apparatus of claim 2 wherein the support means is connected to the substantial center of gravity of the plate.

4. The apparatus of claim 1 wherein the support means is connected to the substantial center of gravity of the plate.

5. The apparatus of claim 1 wherein the support means comprises a flexible member for suspending the plate.

6. The apparatus of claim 1 wherein the support means comprises a weight comprising a length of chain.

7. A chimney cleaner for cleaning a chimney flue wall, comprising:

a plate having at least one pair of substantially perpendicular edges, at least one adjoining pair of substantially perpendicular edges being joined by a radius which substantially conforms to a radius of a chimney corner, the at least one pair of substantially perpendicular edges and adjoining radius comprising a bevelled scraping edge; and support means for suspending the plate between the weight and a flexible member, the support means comprising means for permitting the plate to pivot between the weight and the flexible member and for holding the plate generaly normally to the chimney flue wall.

8. The apparatus of claim 7 wherein the support means comprises:

a first rigid member extending orthogonally from the surface of the plate in a first direction at a site on the plate spaced from the edge of the plate, the first rigid member having an end spaced away from the plate;

means for connecting a flexible member to the end of the first rigid member spaced away from the plate;

a second rigid member extending orthogonally from the surface of the plate in a second direction at a site on the plate spaced from the edge of the plate, the second rigid member having an end spaced away from the surface of the plate; and means for connecting a weight to the end of the second rigid member spaced away from the plate.

9. The apparatus of claim 8 wherein the support means is connected to the substantial center of gravity of the plate.

10. The apparatus of claim 7 wherein the support means is connected to the substantial center of gravity of the plate.

11. The apparatus of claim 7 wherein the support means comprises a flexible member for suspending the plate.

12. The apparatus of claim 7 wherein the support means comprises a weight comprising a length of chain.

13. A chimney cleaner for cleaning a chimney flue wall, comprising:

a plate having four substantially perpendicular edges, each of the substantially perpendicular edges being joined by a radius which substantially conforms to a radius of a chimney flue corner, the four edges and the radii comprising a bevelled scraping edge; and a support means for suspending the plate between a weight and a flexible member, the support means comprising means for permitting the plate to pivot between the weight and the flexible member and for holding the plate generally normally to the chimney flue wall.

14. The apparatus of claim 13 wherein the support means comprises:

a first rigid member extending orthogonally from the surface of the plate in a first direction at a site on the plate spaced from the edge of the plate, the first rigid member having an end spaced away from the plate;

means for connecting a flexible member to the end of the first rigid member spaced away from the plate;

a second rigid member extending orthogonally from the surface of the plate in a second direction at a site on the plate spaced from the edge of the plate, the second rigid member having an end spaced away from the surface of the plate; and means for connecting a weight to the end of the second rigid member spaced away from the plate.

15. The apparatus of claim 14 wherein the support means is connected to the substantial center of gravity of the plate.

16. The apparatus of claim 13 wherein the support means is connected to the substantial center of gravity of the plate.

17. The apparatus of claim 13 wherein the support means comprises a flexible member for suspending the plate.

18. The apparatus of claim 13 wherein the support means comprises a weight comprising a length of chain.

19. A method of cleaning a chimney flue wall comprising the steps of:

suspending a plate between a weight and a flexible member so that the plate is allowed to pivot between the weight and the flexible member and is held generally normally to the flue wall; and raising and lowering the flexible member so that an edge of the plate scrapes a flue wall.

20. The method of claim 19 wherein the weight comprises a length of chain suspended from the plate.

21. A chimney cleaner for cleaning a chimney flue wall, comprising:

a plate having a scraping edge; and support means for suspending the plate between a weight and a flexible member and for automatically forcing the scraping edge into a chimney flue wall when the flexible member is drawn across an upper corner of the chimney flue, the support means comprising means for permitting the plate to pivot between the weight and the flexible member and for holding the plate generally normally to the chimney flue wall.

22. The apparatus of claim 21 wherein the support means comprises:

a first rigid member extending orthogonally from the surface of the plate in a first direction at a site on the plate spaced from the edge of the plate, the first rigid member having an end spaced away from the plate;

means for connecting a flexible member to the end of the first rigid member spaced away from the plate;

a second rigid member extending orthogonally from the surface of the plate in a second direction at a site on the plate spaced from the edge of the plate, the second rigid member having an end spaced away from the surface of the plate; and means for connecting a weight to the end of the second rigid member spaced away from the plate.

23. The apparatus of claim 22 wherein the support means is connected to the substantial center of gravity of the plate.

24. The apparatus of claim 21 wherein the support means is connected to the substantial center of gravity of the plate.

25. The apparatus of claim 21 wherein the support means comprises a flexible member for suspending the plate.

26. The apparatus of claim 21 wherein the support means comprises a weight comprising a length of chain.

* * * * *